United States Patent [19]

McConnell

[11] 4,076,202

[45] Feb. 28, 1978

[54] SHIM FOR RACK COLUMN

[75] Inventor: Kennedy McConnell, Homewood, Ill.

[73] Assignee: Interlake, Inc., Oak Brook, Ill.

[21] Appl. No.: 781,173

[22] Filed: Mar. 25, 1977

[51] Int. Cl.[2] ..... F16M 11/24

[52] U.S. Cl. ..... 248/188.2; 248/23; 248/188.9

[58] Field of Search ..... 248/23, 188.2, 188.9; 52/292, 296, 297

[56] References Cited

U.S. PATENT DOCUMENTS

| | | | |
|---|---|---|---|
| 1,741,487 | 12/1929 | Vance | 248/188.2 |
| 1,798,272 | 3/1931 | Phillips | 248/188.2 |
| 2,110,005 | 3/1938 | Rees | 248/188.2 |
| 2,366,867 | 1/1945 | Nichthauser | 248/188.2 |
| 2,654,420 | 10/1953 | Rogers | 248/188.2 X |

FOREIGN PATENT DOCUMENTS

| | | | |
|---|---|---|---|
| 1,247,577 | 8/1967 | Germany | 248/188.2 |

*Primary Examiner*—Roy D. Frazier
*Assistant Examiner*—Peter A. Aschenbrenner
*Attorney, Agent, or Firm*—Vogel, Dithmar, Stotland, Stratman & Levy

[57] ABSTRACT

A nestable shim includes a flat plate having a ridge portion with a convex upper surface and a concave lower surface, adaptable to be received beneath the foot plate of a rack column for adjusting the height thereof, wherein the foot plate has a concave groove in the bottom surface thereof in which the ridge portion of the shim nests in use. The top and bottom surfaces of the ridge portion are complementary to permit nesting of a plurality of the shims. The foot plate and the shim each have three fastener-receiving apertures therethrough. Alternatively, a slot may be used in place of one of the shim apertures.

13 Claims, 5 Drawing Figures

SHIM FOR RACK COLUMN

BACKGROUND OF THE INVENTION

The present invention relates to shims for adjusting the height or elevation of columns such as the columns of rack constructions.

In general, column-mounted rack constructions are disclosed in U.S. Pat. No. 3,042,221, issued to G. E. Rasmussen on July 3, 1962, and assigned to the assignee of the present invention. It is, in general, known to mount the bottoms of such rack columns on suitable foot members to facilitate fastening the columns to the floor or other underlying support surface. In general, the concept of utilizing shims to adjust the height or elevation of a column is well known. But it has been found that in utilizing shims, e.g., for leveling a rack construction or other construction having a plurality of legs or columns, it is frequently necessary to shim more than one of the columns. In this case the shims under one column will frequently become disoriented and displaced from one another while another column is being adjusted. Furthermore, where the rack construction is loaded, it may be very difficult to drive a shim beneath the column foot member and keep it in proper alignment so as to be disposed substantially congruent with the foot plate. These difficulties are particularly aggravated when more than one shim is utilized beneath each column.

SUMMARY OF THE INVENTION

In the present invention there is provided a unique shim construction for use with a modified foot plate of a rack column.

It is an important feature of the present invention that the shim is nestable with the foot plate and with other like shims so as to prevent lateral displacement of the shims with respect to each other and with respect to the foot plate.

It is another important feature of this invention that the nesting is achieved by an elongated ridge portion on each of the shims, which also serves to facilitate maintaining the alignment of the shims with respect to each other and with respect to the foot plate during insertion of the shim beneath the foot plate.

It is another important feature of this invention that both the foot plate and the shims are provided with fastener-receiving apertures therethrough.

Another feature of the invention is the provision of a fastener-receiving slot in one end of the shim so that it may be inserted beneath the foot plate without the necessity of removing the fastener from the foot plate.

These features are attained, and it is an important object of the present invention to obtain these advantages by providing a nestable shim to control the elevation of an associated column resting on a foot member which has a flat bottom surface with an elongated concave groove therein, the shim comprising a flat plate having an elongated ridge portion with a convex top surface and a concave bottom surface, the convex top surface being shaped and dimensioned to nest within the groove in the foot member when received therebeneath for cooperation therewith to prevent lateral displacement of the plate from the foot member, the top and bottom surfaces of the ridge portion being complementary to each other to permit stacking of a plurality of the plates with each top surface being nested within the bottom surface of the immediately overlying one of the plates, whereby a plurality of the shims may be stacked beneath the foot member to elevate the column while preventing lateral displacement of the shims with respect to each other and the foot member.

Further features of the invention pertain to the particular arrangement of the parts of the nestable shim whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENTS

Figure 1:
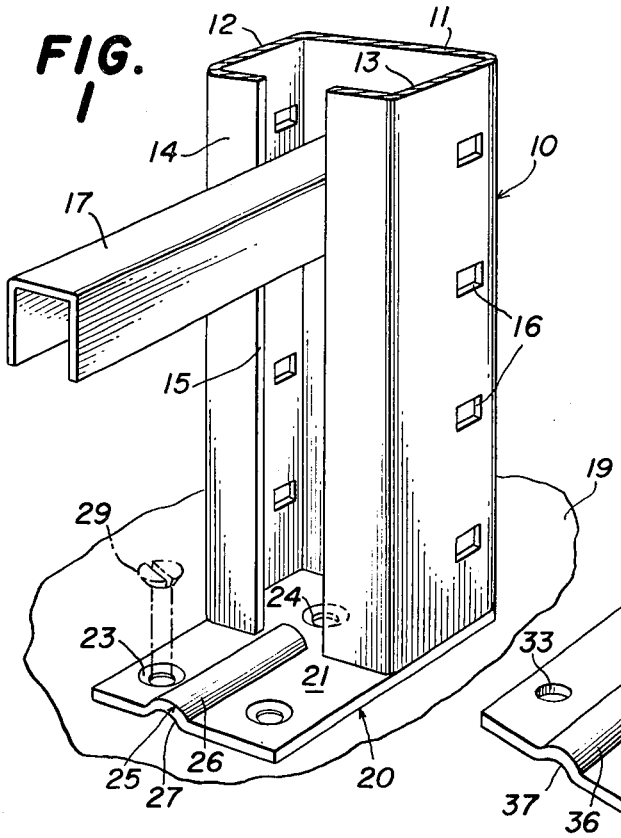
FIG. 1 is a fragmentary perspective view of a column and foot plate of the type with which the shim of the present invention is utilized.
Figure 2:
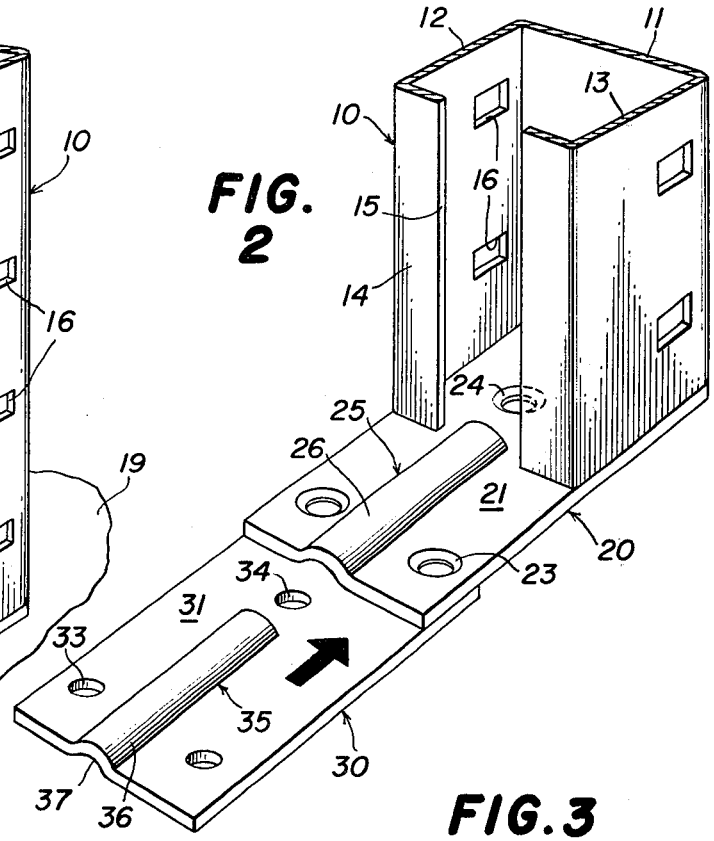
FIG. 2 is a view similar to FIG. 1, and illustrating the insertion of the shim beneath the foot plate in accordance with the present invention.

Referring to FIG. 1 of the drawings, there is illustrated a column, generally designated by the numeral 10, which may be one of the several columns in a pallet rack construction. The column 10 is a hollow, generally rectangular member including four rectangular side walls 11, 12 13 and 14, with the side wall 14 having a longitudinally extending slot 15 formed therein. The side walls 12 and 13 are preferably provided with a plurality of longitudinally spaced-apart apertures 16 therethrough to facilitate mounting of beams and other cross members on the column 10. A cross brace 17 may be received in the slot 15 and secured to the column 10 by suitable means for connecting the column 10 to other like columns of the rack construction.

The column 11 is provided at the bottom end thereof with a foot plate, generally designated by the numeral 20, for mounting the column 11 on the floor or other underlying support surface 19. The foot plate 20 is generally rectangular in shape and may be secured to the column 11 as by welding, the foot plate 20 having an upper surface 21 and a lower surface 22 (see FIG. 5) and being provided with a pair of laterally spaced-apart forward countersunk holes 23 and a centered rear countersunk hole 24 therethrough for receiving suitable fasteners such as screws 29 or the like. Extending longitudinally centrally of the foot plate 20 from one end thereof is a ridge portion, generally designated by the numeral 25, which has a convex top surface 26 and a concave bottom surface 27 which defines a groove in the bottom of the foot plate 20, the inner end of the ridge portion 25 terminating a predetermined short distance forwardly of the rear hole 24.

A shim, generally designated by the numeral 30, is provided for insertion beneath the foot plate 20 to adjust the elevation of the column 11. The shim 30 comprises a flat rectangular plate substantially the same size and shape as the foot plate 20 and having an upper surface 31 and a lower surface 32, and being provided with a pair of laterally spaced-apart forward apertures 33 and a rearward aperture 34 therethrough, the apertures 33 and 34 being respectively alignable with the holes 23 and 24 in the foot plate 20 when the shim 30 is disposed beneath the foot plate 20 substantially congruent therewith. Extending longitudinally centrally of the shim 30 from one end thereof is a ridge portion, generally designated by the numeral 35, the ridge portion 35 having a convex top surface 36 and a concave bottom surface 37 and having the inner end thereof disposed a predetermined short distance forwardly of the rear aperture 34.

Figure 5:
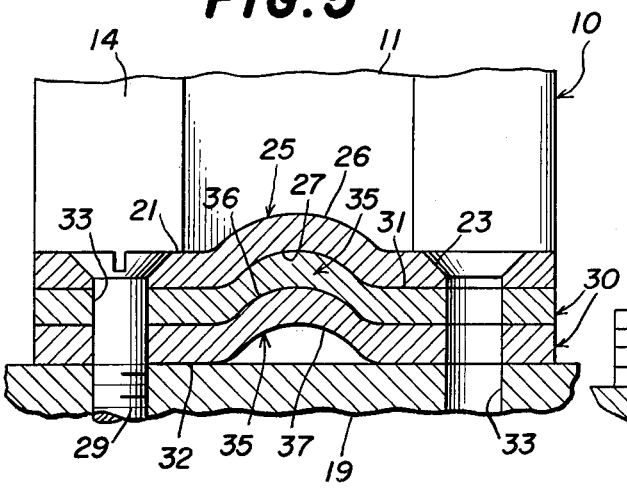
FIG. 5 is an enlarged view in vertical section taken along the line 5—5 in FIG. 4.
Figure 4:
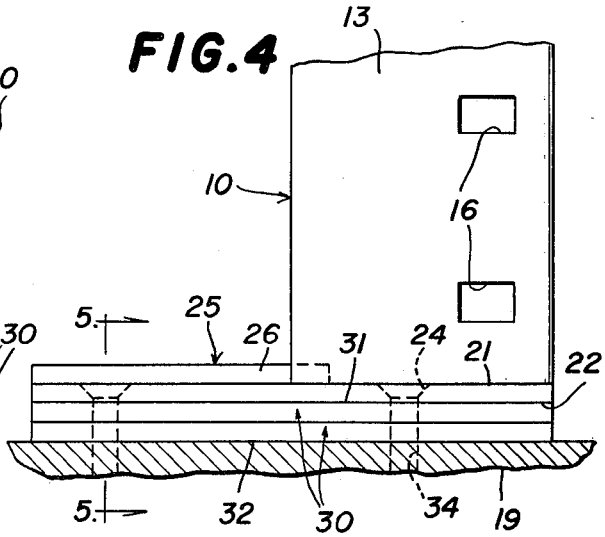
FIG. 4 is a side elevational view of the column set forth in FIG. 2, with two shims fully inserted beneath the foot plate.

Referring in particular to FIG. 5 of the drawings, it can be seen that the top and bottom surfaces 36 and 37 of the ridge portion 35 of the shim 30 are formed complementary to each other, so as to permit a plurality of the shims 30 to be stacked with the ridge portions thereof nesting together. Similarly, it will be noted that the convex top surface 36 of the shim 30 is complementary to the concave bottom surface 27 of the foot plate 20 so that the ridge portion 35 of the shim 30 may nest within the bottom groove of the foot plate 20. It will be appreciated that, in use, the nesting of the ridge portion 35 of the shim 30 with other like shims and with the bottom groove of the foot plate 20 serves to prevent lateral displacement of the shims 30 with respect to each other and with respect to the foot plate 20. In addition, this nesting arrangement serves as a longitudinal guide to facilitate insertion of a shim 30 beneath the foot plate 20. When the desired number of shims 30 have been inserted beneath the foot plate, a fastener 29 is placed through aligned ones of the holes and apertures in the foot plate 20 and shims 30 for securing same to the underlying support surface 19.

Normally, the rack construction is mounted on a concrete floor and, therefore, it is necessary to drill holes in the floor for the fasteners 29. For this reason, normally only one fastener 29 is used to anchor each foot plate 20 to the floor 19. Three holes are provided simply to afford alternative positionings of the fastener, in the event that a tie rod or other such obstruction was hit during the drilling of the first hole. It will be noted that the placement of the holes 23 and 33 at the sides of the foot plate 20 and shim 30 permit drilling of the holes and mounting of the fasteners 29 with the column 10 in place, without interference by the cross brace 17. If the holes 24 and 34 must be used, the column 10 must be moved during drilling, and then a suitable ratchet type wrench must be used to mount the fastener 29.

Figure 3:
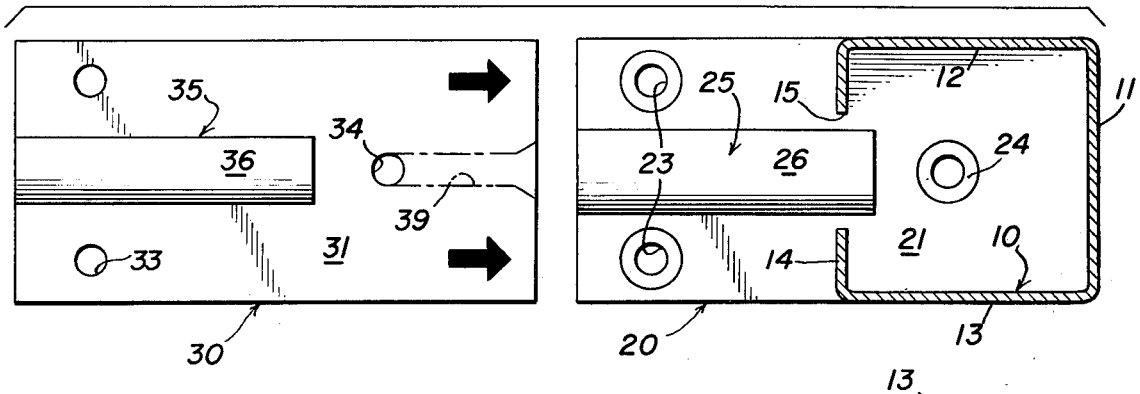
FIG. 3 is a top plan view of the column illustrated in FIG. 1, with a shim positioned for insertion beneath the column foot plate.

Referring in particular to FIG. 3 of the drawings, there is illustrated an alternative version of the shim 30, wherein the rear aperture 34 may be replaced with an elongated slot 39, illustrated in broken line. The slot 39 opens to the rear end of the shim 30 and has a width slightly greater than the diameter of the fastener 29. It will be appreciated that this slotted version of the shim 30 facilitates insertion thereof beneath the foot plate 20 without removal of the fastener in the holes 24 and 34, in the event that a fastener is used in that hole. The rear fastener in the holes 24 and 34 could then simply be loosened but remain in place while the shim 30 is inserted, the cooperation of the fastener 29 with the slot 39 in the shim 30 serving as an additional guide for the shim 30. The cooperation of the fastener 29 with the slot 39 will also serve to help retain the shims 30 and foot plate 20 in proper relationship with one another while other columns 11 of the construction are adjusted, before the other fastener is retightened.

From the foregoing, it can be seen that there has been provided an improved shim for use with a rack column. More particularly, there has been provided a nestable shim having a longitudinal ridge portion which facilitates nesting of a plurality of the shims together with each other and with a modified column foot plate to prevent lateral displacement of the shims.

There has also been provided a nestable shim which is provided with a slotted rear end to facilitate insertion beneath the column foot plate without removal of all of the foot plate fasteners.

Finally, there has been provided the combination of the unique shim with a modified foot plate for a rack column.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A nestable shim to control the elevation of an associated column resting on a foot member which has a flat bottom surface with an elongated concave groove therein, said shim comprising a flat plate having an elongated ridge portion with a convex top surface and a concave bottom surface, said convex top surface being shaped and dimensioned to nest within the groove in the foot member when received therebeneath for cooperation therewith to prevent lateral displacement of said plate from the foot member, said top and bottom surfaces of said ridge portion being complementary to each other to permit stacking of a plurality of said plates with each said top surface being nested within the bottom surface of the immediately overlying one of said plates, whereby a plurality of said shims may be stacked beneath the foot member to elevate the column while preventing lateral displacement of said shims with respect to each other and the foot member.

2. The nestable shim set forth in claim 1, wherein said ridge portion extends longitudinally of said plate less than the entire length thereof.

3. The nestable shim set forth in claim 1, wherein said ridge portion extends centrally of said plate.

4. The nestable shim set forth in claim 1, wherein said plate has a plurality of apertures therethrough respectively alignable in use with corresponding holes in the foot member for receiving associated fasteners therethrough.

5. The nestable shim set forth in claim 1, wherein said ridge portion extends longitudinally centrally of said plate less than the entire length thereof, said plate having three apertures therethrough respectively alignable with corresponding holes in the foot member for receiving associated fasteners therethrough, two of said apertures respectively flanking said ridge portion and the third said aperture being disposed in alignment with said ridge portion adjacent to the inner end thereof.

6. A nestable shim to control the elevation of an associated column resting on a foot member which has a flat bottom surface with an elongated concave groove therein and an aperture for receiving therethrough an associated fastener to secure the foot member to an underlying support surface, said shim comprising a flat plate having an elongated ridge portion with a convex top surface and a concave bottom surface, said convex top surface being shaped and dimensioned to nest within the groove in the foot member when received therebeneath for cooperation therewith to prevent lateral displacement of said plate from the foot member, said top and bottom surfaces of said ridge portion being complementary to each other to permit stacking of a plurality of said plates with each said top surface being nested within the bottom surface of the immediately overlying one of said plates, said plate having an elongated slot formed in one end thereof and dimensioned to receive the associated fastener therein to permit sliding of said plate into position beneath the foot member without removing the associated fastener, whereby a plurality of said shims may be stacked beneath the foot member to elevate the column while preventing lateral displacement of said shims with respect to each other and the foot member.

7. The nestable shim set forth in claim 6, wherein said slot extends longitudinally of said plate centrally thereof.

8. The nestable shim set forth in claim 6, wherein said ridge portion extends longitudinally centrally of said plate from one end thereof to a point intermediate the ends thereof, said slot extending from the other end of said plate in longitudinal alignment with said ridge portion and terminating a predetermined distance from the inner end of said ridge portion.

9. The nestable shim set forth in claim 6, wherein said plate has two apertures therethrough respectively flanking said ridge portion and respectively alignable with corresponding holes in the foot member for receiving associated fasteners therethrough.

10. A combination for controlling the elevation of an associated column, said combination comprising a foot member adapted to be secured to the bottom of the column, said foot member having a flat bottom surface with an elongated concave groove therein; and a nestable shim including a flat plate having an elongated ridge portion with a convex top surface and a concave bottom surface, said convex top surface being shaped and dimensioned to nest within said groove in said foot member when received therebeneath for cooperation therewith to prevent lateral displacement of said plate from said foot member, said top and bottom surfaces of said ridge portion being complementary to each other to permit stacking of a plurality of said plates with each said top surface being nested within the bottom surface of the immediately overlying one of said plates, whereby a plurality of said shims may be stacked beneath said foot member to elevate the column while preventing lateral displacement of said shims with respect to each other and said foot member.

11. The combination set forth in claim 10, wherein said foot member includes a plurality of holes therethrough, said shim plate having a plurality of apertures therethrough respectively alignable in use with said holes in said foot member for receiving associated fasteners therethrough.

12. The combination set forth in claim 10, wherein said ridge portion extends longitudinally centrally of said plate.

13. The combination set forth in claim 10, wherein said foot member has a hole therein for receiving therethrough an associated fastener to secure the foot member to an underlying support surface, said plate of said nestable shim having an elongated slot formed in one end thereof and dimensioned to receive the associated fastener therein to permit sliding of said plate into position beneath said foot member without removing the associated fastener.

* * * * *